US009508461B2

(12) United States Patent
Elie et al.

(10) Patent No.: US 9,508,461 B2
(45) Date of Patent: Nov. 29, 2016

(54) POLYMERIC OVERCOATED ANODIZED WIRE

(71) Applicant: Ford Global Technologies, LLC, Dearborn, MI (US)

(72) Inventors: Larry Dean Elie, Ypsilanti, MI (US); Allan Roy Gale, Livonia, MI (US); John Matthew Ginder, Plymouth, MI (US); Clay Wesley Maranville, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 505 days.

(21) Appl. No.: 13/654,781

(22) Filed: Oct. 18, 2012

(65) Prior Publication Data

US 2014/0110147 A1 Apr. 24, 2014

(51) Int. Cl.

| | |
|---|---|
| ***H01B 15/00*** | (2006.01) |
| ***H01B 9/02*** | (2006.01) |
| ***H01B 1/02*** | (2006.01) |
| ***H01B 3/10*** | (2006.01) |
| ***H01B 7/00*** | (2006.01) |
| *H01B 13/16* | (2006.01) |

(52) U.S. Cl.

CPC ..... *H01B 1/026* (2013.01); *H01B 3/105* (2013.01); *H01B 7/0009* (2013.01); *H01B 13/16* (2013.01)

(58) Field of Classification Search

CPC .... H01B 1/026; H01B 3/105; H01B 7/0009; H01B 13/16

USPC ..... 174/102 C, 110 A

See application file for complete search history.

(56) References Cited

U.S. PATENT DOCUMENTS

| | | | | |
|---|---|---|---|---|
| 7,572,980 | B2 | 8/2009 | Elie et al. | |
| 7,816,065 | B2 | 10/2010 | Fromson et al. | |
| 7,820,300 | B2 | 10/2010 | Dolan | |
| 7,935,885 | B2 * | 5/2011 | Elie | H01B 3/105 174/110 R |
| 2008/0254281 | A1 * | 10/2008 | Chen | B29C 51/004 428/335 |
| 2009/0271977 | A1 | 11/2009 | Elie et al. | |

OTHER PUBLICATIONS

Grafix Plastics, Quality Plastic Film & Sheeting, "Plastic Film: What Material Am I Looking For".

* cited by examiner

*Primary Examiner* — Timothy Thompson
*Assistant Examiner* — Paul McGee, III
(74) *Attorney, Agent, or Firm* — LeClairRyan

(57) ABSTRACT

An insulated electric conductor and method for making such a conductor are disclosed. The conductor comprises a copper core, a layer of aluminum formed over the copper core, an aluminum oxide dielectric layer formed over the layer of aluminum, and a thin polymeric layer formed over the aluminum oxide dielectric layer. The thin polymeric layer is preferably between about 30 microns (0.001") and about 500 microns (0.02") and is more preferably between about 45 microns (0.0015") and about 250 microns (0.01"). The polymeric layer may be any polymeric material selected from the group consisting of acrylic resins, epoxy resins, polyurethane resins, and silicone resins. Other polymeric materials may be used. The polymeric layer may be formed by a variety of methods including, but not limited to, spraying, brushing, dipping, and powder coating.

6 Claims, 4 Drawing Sheets

10
12
14
16
18
20
12
14
16
18

30
32
34
36
38
40
32
34
36
38

50
52
54
56
58
60
52
54
56
58

70
72
74
76
78
80
72
74
76
78

POLYMERIC OVERCOATED ANODIZED WIRE

TECHNICAL FIELD

The disclosed invention relates generally to anodized wire having a polymeric coating. More particularly, the disclosed invention relates to copper wire having an anodized aluminum layer formed thereover followed by the overacting of a thin layer of polymeric material on the anodized aluminum layer.

BACKGROUND OF THE INVENTION

The insulation of electrically conductive wire used to form a coil or similar conductive article is generally established and may be undertaken by a number of methods, including the fundamental approaches of coating with an organic polymerized material or anodization. With respect to the first approach, any one of several organic wire coatings selected from the group consisting of plastics, rubbers and elastomers will provide effective insulation on conductive material. However, these coatings tend to be relatively heavy and thus generally are not effective at dissipating ohmic or resistance heating when used in coil windings.

In addition to coating conductive material with an organic substance, electrically conductive materials such as copper and aluminum may be anodized to provide some measure of insulation. In the case of a copper core, the anodization of this material is known to produce unsatisfactory results due to cracking. It is possible to electroplate copper with aluminum but this approach generally produces undesirable results in terms of durability of the coating. In the case of an aluminum core, copper can be plated on the core but results in unsatisfactory electrical efficiency.

An electrically insulated conductor for carrying signals or current having a solid or stranded copper core of various geometries with only a single electrically insulating and thermally conductive layer of anodized aluminum (aluminum oxide) is disclosed in U.S. Pat. No. 7,572,980. As described in the '980 patent, the device is made by forming uniform thickness thin sheet or foil of aluminum to envelop the copper conductive alloy core. The aluminum has its outer surface partially anodized either before or after forming to the core in an electrolytic process to form a single layer of aluminum oxide.

This and other examples of the known art represent improvements in the coating of wire and other forms of electrical transmission. However, as in so many areas of technology, there is room in the art of wire coating for further advancement.

SUMMARY OF THE INVENTION

The disclosed invention provides an insulated electric conductor. The conductor comprises a copper core, a layer of aluminum formed over the copper core, an aluminum oxide dielectric layer formed over the layer of aluminum, and a thin polymeric layer formed over the aluminum oxide dielectric layer. The thin polymeric layer is preferably between about 30 microns (0.001") and about 500 microns (0.02") and is more preferably between about 45 microns (0.0015") and about 250 microns (0.01"). The preferable range is relatively broad as there may be cases where the absolute minimum coat is applied as a multi-layer coat. It also may be that a thick dip coating is preferred. The polymeric layer may be any polymeric material selected from the group consisting of acrylic resins, epoxy resins, polyurethane resins, and silicone resins. Other polymeric materials may be used.

The polymeric layer may be formed by a variety of methods including, but not limited to, spraying, brushing, dipping, and powder coating. Once applied, the coated conductor adds to the positive characteristics of anodized wire alone by demonstrating the superior characteristics of filling micro cracks that may develop during winding while being cost effective in both production and operation.

The insulated electric conductor of the disclosed invention offers many advantages in application and operation and may find superior utility in high power electrical motors, high voltage traction battery subsystems, generators, alternators, and in hybrid vehicles and operating systems for such vehicles.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

Figures 1A, 1B, 1C, 1D:
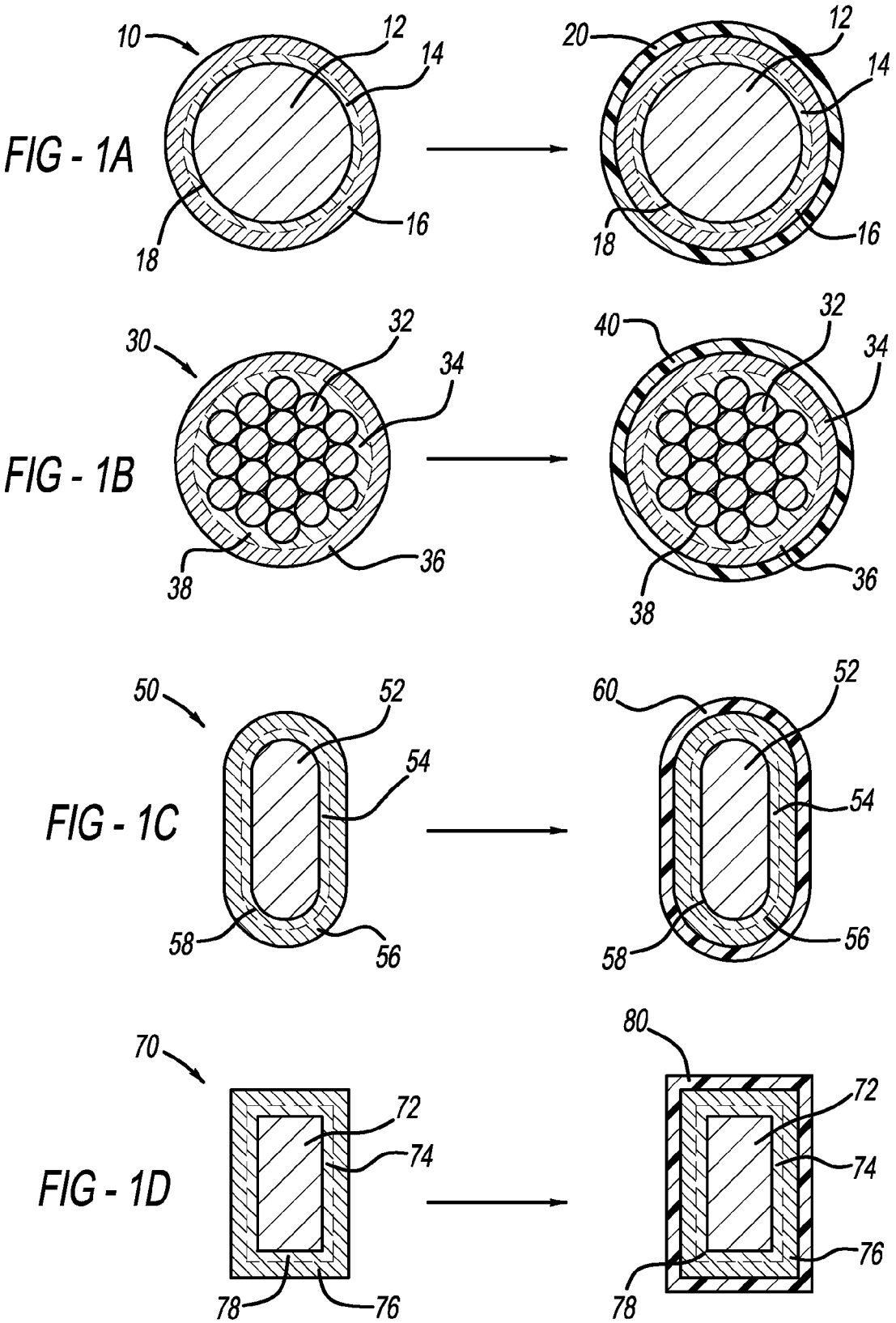
FIGS. 1A-1D are sectional views of wires and related electrical conductors illustrated before and after being overcoated with a thin layer of polymeric material according to the disclosed invention.

In the following figures, the same reference numerals will be used to refer to the same components. In the following description, various operating parameters and components are described for different constructed embodiments. These specific parameters and components are included as examples and are not meant to be limiting.

With respect to FIGS. 1A-1D, sectional views of wires and related electrical composite conductors illustrated before and after being overcoated with a thin layer of high-purity aluminum according to the disclosed invention are illustrated. The wires and related conductors are preferably although not necessarily formed according to the methods and materials set forth in U.S. Pat. No. 7,572,980 and incorporated by reference in its entirety herein. The '980 patent is assigned to the same assignee to which the disclosed invention is assigned.

With particular reference to FIG. 1A, a sectional view of a composite conductor, generally illustrated as 10, is shown. The composite conductor 10 includes a copper or copper alloy core 12 and an aluminum layer 14. As set forth in the '980 patent, the aluminum layer 14 is formed by enveloping the copper core 12 with a uniform thickness thin sheet of aluminum and partially anodizing the outer surface of the sheet to form a dielectric layer 16 of aluminum oxide. The dielectric layer 16 electrically insulates the copper core 12 while being thermally conductive to dissipate heat generated due to normal operations. A thin layer 18 of electrically conductive aluminum surrounds the core 12 and facilitates adhesion or bonding of dielectric layer 16 to the core 12.

According to the disclosed invention, the composite conductor 10 may be further insulated to achieve a high uniform electrical breakdown and thus expand the utility of electrically conductive composite wire beyond the range previously known. This is achieved by adding a layer of high-purity aluminum. The high-purity aluminum is the result of the refining of aluminum to remove impurities resulting in purity of at least 99.99%. The layer of high-purity aluminum, illustrated as 20 in FIG. 1A, may be formed by methods described below.

Referring to FIG. 1B, a sectional view of an alternate embodiment of the composite conductor according to the disclosed invention, generally illustrated as 30, is shown. The composite conductor 30 includes a copper or copper alloy core 32 formed from a plurality of independent copper or copper alloy strands. The composite conductor 30 further includes an aluminum layer 34, the outer surface of which has been anodized according to the method of the '980 patent to form dielectric layer 36 of aluminum oxide. A thin layer 38 of electrically conductive aluminum surrounds the core 32. The composite conductor 30 has a layer of high-purity aluminum 40 formed thereover.

FIGS. 1C and 1D illustrate variations in the shape of the composite conductor according to the disclosed invention. With reference first to FIG. 1C, a sectional view of a composite conductor is generally illustrated as 50. The composite conductor 50 includes a generally flat copper or copper alloy core 52. The composite conductor 50 further includes an aluminum layer 54, the outer surface of which has been anodized to form dielectric layer 56 of aluminum oxide. A thin layer 58 of electrically conductive aluminum surrounds the core 52. The composite conductor 50 has a layer of high-purity aluminum 60 formed thereover.

With reference to FIG. 1D, a sectional view of an additional variation of the composite conductor of the disclosed invention is generally illustrated as 70. The composite conductor 70 includes a generally rectangular copper or copper alloy core 72. The composite conductor 70 includes an aluminum layer 74, the outer surface of which has been anodized to form dielectric layer 76 of aluminum oxide. A thin layer 78 of electrically conductive aluminum surrounds the core 72. The composite conductor 70 has a layer of high-purity aluminum 80 formed thereover.

Figure 2:
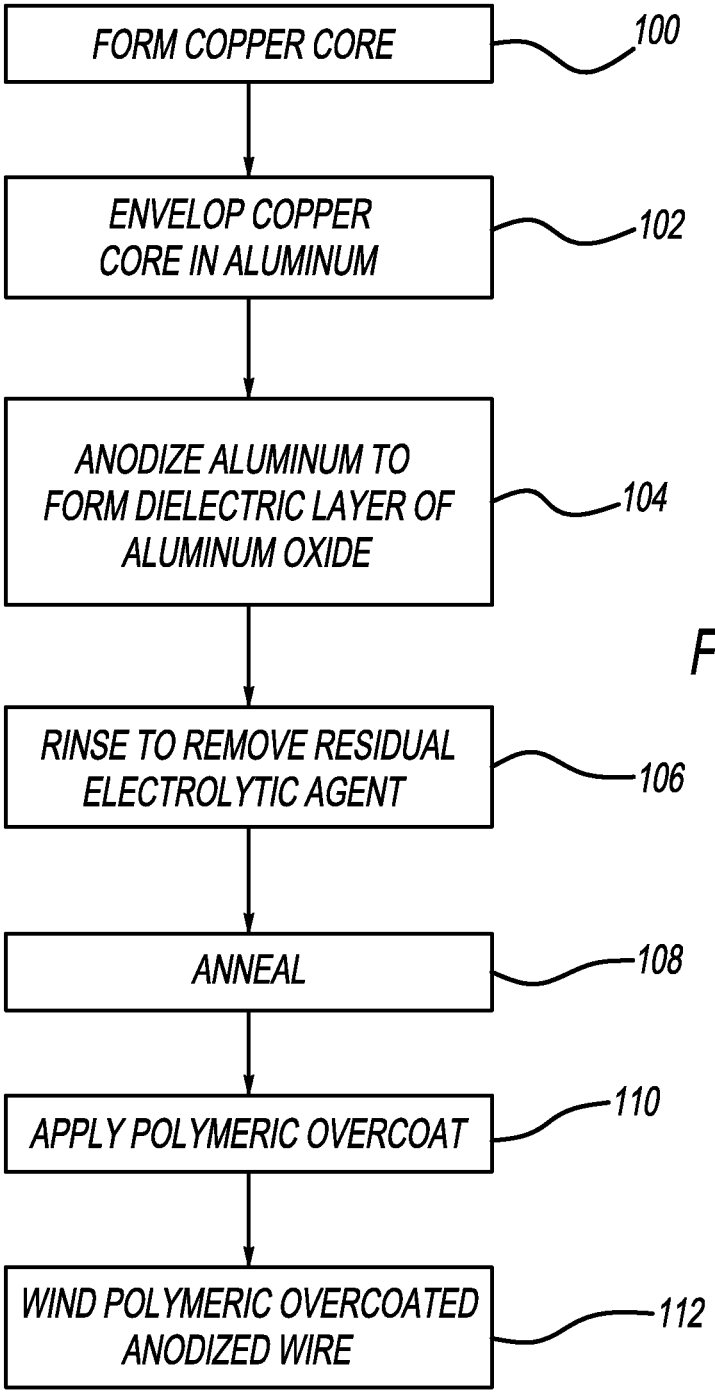
FIG. 2 is a flow chart illustrating the method for overcoating anodized wire with a thin layer of polymeric material according to the disclosed invention.

Regardless of the structure of the copper or copper alloy core or the shape, the high-purity aluminum coating of the composite conductor of the disclosed invention may be formed by alternative techniques. FIG. 2 sets forth a flow chart according to the disclosed invention for forming a polymeric coating on the composite conductor according to the disclosed invention.

Referring to FIG. 2, at a first step 100 the copper core is formed. As set forth above with respect to FIGS. 1A-1D, the copper core may be solid or may be composed of multiple strands. Furthermore the copper core may be copper or copper alloy. Once the copper core is formed, the copper core is enveloped in a thin sheet or foil of aluminum at step 102. Particularly, and as set forth in the '980 patent, at step 102 the copper core (12, 32, 52, 72) is enveloped in a thin sheet of aluminum (14, 34, 54, 74). One or more thin sheets may be used depending on desired core geometry or other parameters. The aluminum sheet may be applied by any technique including but not limited to mechanical cold-forming techniques, co-extrusion techniques, vacuum welding, or RF bonding or any combination thereof.

Once the aluminum layer envelops the copper core at step 102 the outer surface of the aluminum is partially anodized at step 104. This is done using an electrolytic process to form a single homogeneous dielectric layer. It is preferred though not required that the outer layer is only partially anodized thus leaving a thin layer of aluminum in contact with the copper core. In addition, the step of anodizing the aluminum may be undertaken before being applied to the copper core.

At step 106 the anodized aluminum may be rinsed according to an optional step of the disclosed invention. Rinsing of the anodized aluminum stops the anodization process by removing the electrolytic solution.

A further optional step arises at step 108 in which the conductor, now a composite, is annealed. The annealing process reduces or eliminates stresses that may be present in the core, the aluminum layer, the dielectric aluminum oxide layer, or between layers.

Once the aluminum layer has been anodized and optionally rinsed and annealed a coating of a polymeric material is applied at step 110. As will be set forth below, the polymeric coating may be applied by any of several methods, including but not limited to spraying, brushing, dipping, or powder coating.

Once the polymeric coating is applied at step 110 the polymeric overcoated anodized wire is optionally wound onto a mandrel for use in an electric motor (not shown) at step 112. Of course it is not necessary that the formed wire is so wound and instead it may be directed elsewhere, such as to a spool for later use.

The composite conductor is overcoated with a relatively thin layer of a polymeric material. Particularly, the thin polymeric layer is between about 30 microns (0.001") and about 500 microns (0.02") and is more preferably between about 45 microns (0.0015") and about 250 microns (0.01"). The preferable range is relatively broad as there may be cases where the absolute minimum coat is applied as a multi-layer coat. It also may be that a thick dip coating is preferred. The polymeric layer may be one of several polymeric materials selected from the group consisting of acrylic resins, epoxy resins, polyurethane resins, and silicone resins. Other polymeric materials may be used.

As noted above, the polymeric material may be coated on the prepared anodized wire by one of several methods, including spraying, brushing, dipping and powder coating. For spraying, brushing and dipping in general the acrylic, epoxy, polyurethane and silicone resins are generally preferred. For thermoplastic powder coating polyolefins may be the preferred material.

However, silicone resins may be most attractive in that these resins have an effective operating range of from −55° C. to 200° C. This high temperature resistance makes silicone resins particularly useful as a thin coating in high temperature environments. Use as an electric motor coil winding is one example of how the anodized wire having a thin polymeric coating may find practical and cost-effective placement in industry.

Figure 3:
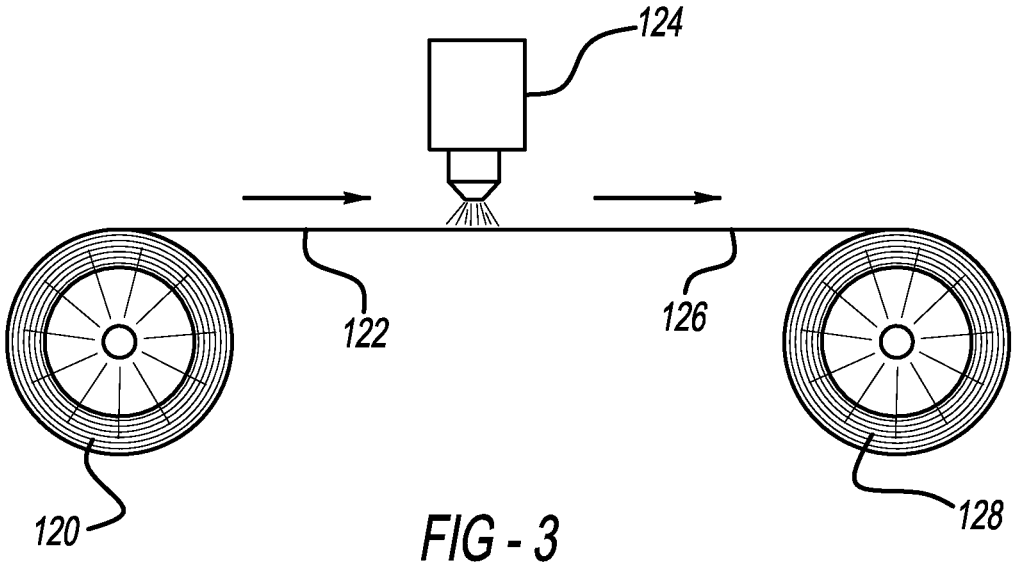
FIG. 3 is a graphical representation of a continuous process for overcoating the anodized layer with a thin layer of polymeric material by spraying.

Referring to FIG. 3, a graphical representation of a continuous process for overcoating the anodized layer with a polymeric material by spraying is illustrated. A supply or feed roll 120 having a continuous length of anodized wire 122 is provided. As noted above with respect to FIGS. 1A through 1D, the wire 122 has a copper or copper alloy core (12, 32, 52, 72) enveloped by a uniform thickness sheet of aluminum (14, 34, 54, 74). A sprayer 124 of a type known in the art applies a thin coating of a flowable polymer onto the anodized wire 122 as the anodized wire 122 passes through the spray to produce an anodized wire 126 having a thin polymeric coating. The coated anodized wire 126 is taken up by a mandrel or a similar spool 128.

Figure 4:
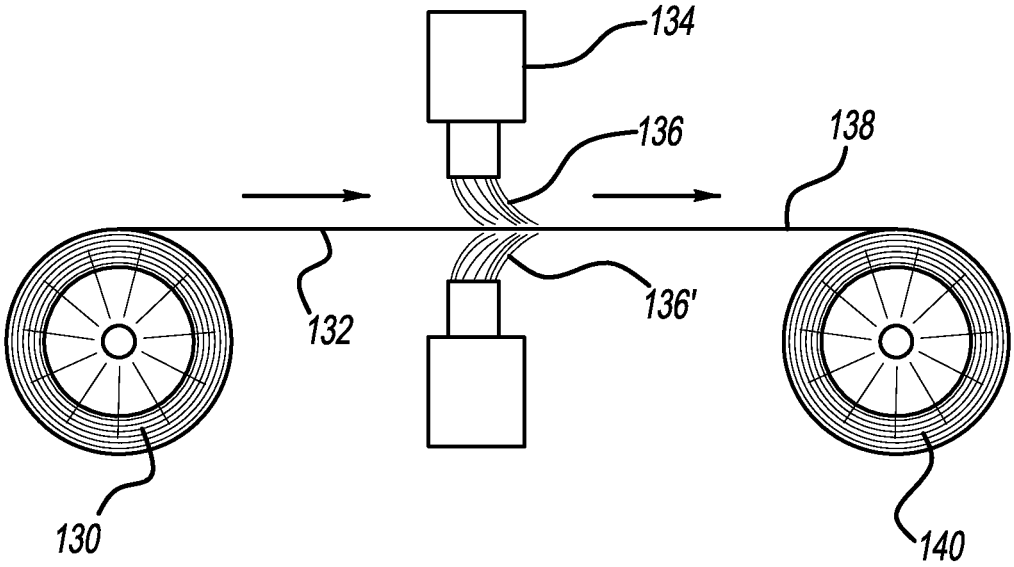
FIG. 4 is a graphical representation of a continuous process for overcoating the anodized layer with a thin layer of polymeric material by brushing.

Referring to FIG. 4, a graphical representation of a continuous process for overcoating the anodized layer with a polymeric material by brushing is illustrated. A supply or feed roll 130 having a continuous length of anodized wire 132 is provided. Again as noted above with respect to FIGS. 1A through 1D, the wire 132 has a copper or copper alloy core (12, 32, 52, 72) enveloped by a uniform thickness sheet of aluminum (14, 34, 54, 74).

A brushing apparatus 134 of a type known in the art having a pair of opposed brushes 136 and 136' applies a thin coating of a flowable polymer onto the anodized wire 122 as the anodized wire 122 passes between the brushes 136 and 136' to produce an anodized wire 138 having a thin polymeric coating. The coated anodized wire 138 is taken up by a mandrel or a similar spool 140.

Figure 5:
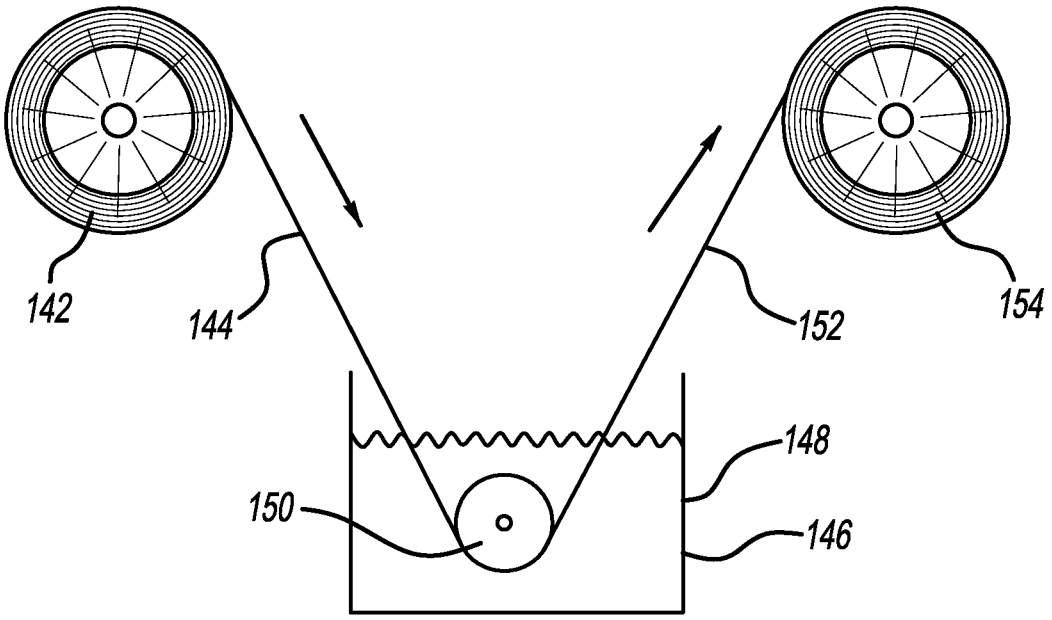
FIG. 5 is a graphical representation of a continuous process for overcoating the anodized layer with a thin layer of polymeric material by dipping.

Referring to FIG. 5, a graphical representation of a continuous process for overcoating the anodized layer with a polymeric material by brushing is illustrated. A supply or feed roll 142 having a continuous length of anodized wire 144 is provided. As before with the spraying and brushing applications illustrated in FIGS. 3 and 4 respectively, the wire 144 has a copper or copper alloy core (12, 32, 52, 72) enveloped by a uniform thickness sheet of aluminum (14, 34, 54, 74).

A dipping apparatus 146 of a type known in the art having a vessel 148 containing a flowable polymeric material is provided. The dipping apparatus 146 further includes a guide roller 150. The guide roller 150 guides the wire 144 into and out of the flowable polymeric material retained in the vessel 148. The wire 144 passes into the vessel 148 and exits the vessel 148 as an anodized wire 152 having a thin polymeric coating. The coated anodized wire 152 is taken up by a mandrel or a similar spool 154.

Figure 6:
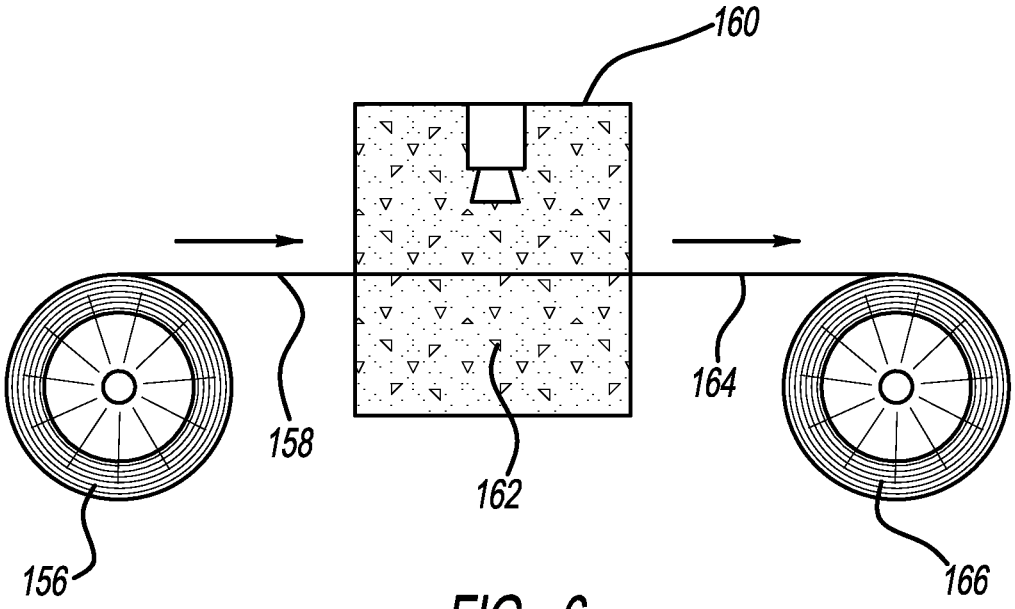
FIG. 6 is a graphical representation of a continuous process for overcoating the anodized layer with a thin layer of polymeric material by powder coating.

Referring to FIG. 6, a graphical representation of a continuous process for overcoating the anodized layer with a polymeric material by powder coating is illustrated. A supply or feed roll 156 having a continuous length of anodized wire 158 is provided. As before with the aforementioned coating applications illustrated in FIGS. 3 through 5, the wire 158 has a copper or copper alloy core (12, 32, 52, 72) enveloped by a uniform thickness sheet of aluminum (14, 34, 54, 74). A powder coating apparatus 160 of a type known in the art is provided.

As is known in the art, a finely divided, dry, solid polymeric powder 162, preferably but not exclusively a polyolefin powder, is electrostatically applied to the anodized wire 158. The coating process produces an anodized wire 164 having a polymeric coating. The coated anodized wire 164 is taken up by a mandrel or a similar spool 166.

The foregoing discussion discloses and describes exemplary embodiments of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. An insulated electric conductor in a coil winding, the conductor comprising:

a copper core;

a layer of aluminum formed over said copper core;

an aluminum oxide dielectric layer formed over said layer of aluminum; and a single polymeric layer formed directly on said aluminum oxide dielectric layer, said polymeric layer having a thickness of more than 50 microns and up to 500 microns.

2. The insulated electric conductor of claim 1 wherein said polymeric layer is a material selected from the group consisting of acrylic resins, epoxy resins, polyurethane resins, and silicone resins.

3. An insulated electric conductor in a coil winding, the conductor comprising:

a copper core;

a layer of aluminum formed over said copper core;

an aluminum oxide dielectric layer formed over said layer of aluminum; and a single polymeric layer formed directly on said aluminum oxide dielectric layer, said polymeric layer having a thickness of more than 50 microns.

4. The insulated electric conductor of claim 3 wherein said polymeric layer is a material selected from the group consisting of acrylic resins, epoxy resins, polyurethane resins, and silicone resins.

5. The insulated electric conductor of claim 3 wherein said polymeric layer has a thickness of more than 50 microns and up to 500 microns.

6. An electric motor coil winding comprising:

a copper core;

a layer of aluminum formed over said copper core;

an aluminum oxide dielectric layer formed over said layer of aluminum; and a single polymeric layer formed directly on said aluminum oxide dielectric layer, said polymeric layer having a thickness of more than 50 microns.

* * * * *